US006179376B1

(12) United States Patent
Meeker et al.

(10) Patent No.: US 6,179,376 B1
(45) **Date of Patent: *Jan. 30, 2001**

(54) CHILD EXERCISER/ROCKER

(75) Inventors: Paul K. Meeker, Hiram; William R. Gibson, Canton; Steve Courtney, Troy, all of OH (US)

(73) Assignee: Evenflo Company, Inc., Dayton, OH (US)

( * ) Notice: Under 35 U.S.C. 154(b), the term of this patent shall be extended for 0 days.

This patent is subject to a terminal disclaimer.

(21) Appl. No.: 08/324,184

(22) Filed: Oct. 3, 1994

Related U.S. Application Data

(63) Continuation-in-part of application No. 08/130,206, filed on Oct. 1, 1993, now Pat. No. 5,407,246.

(51) Int. Cl.[7] ..... A47D 13/10

(52) U.S. Cl. ..... 297/137; 297/258.1; 297/271.5; 297/344.18; 297/344.26; 248/372.1; 248/618

(58) Field of Search ..... 297/5, 136, 137, 297/258.1, 271.5, 374, 344.21, 344.26; 248/143, 372.1, 618; 280/87.051; 135/68, 73, 82; 482/66, 68, 69

(56) References Cited

U.S. PATENT DOCUMENTS 149,178 * 3/1874 Wright ..... 297/270.2 X
432,378 * 7/1890 Davidson et al. ..... 297/137 X
517,403 * 3/1894 Bradish et al. ..... 297/136 X
2,812,012 * 11/1957 Hansburg ..... 297/137
2,910,111 * 10/1959 Hansburg ..... 297/137
2,988,358 * 6/1961 Mills ..... 297/270.1 X

* cited by examiner

*Primary Examiner*—Peter R. Brown
(74) *Attorney, Agent, or Firm*—Thompson Hine & Flory LLP

(57) ABSTRACT

A seat for receipt of a child capable of providing exercise and entertainment comprising a seat having a rigid upper support and a lower support therebeneath and a circular bearing surface therebetween, the lower support having leg openings for passage of the legs of a child supported therein. An upper supporting tray has a radially interior opening in a circular configuration for receiving and supporting the seat, the upper supporting tray having a radially exterior periphery with projections extending downwardly therefrom. A bowl-shaped base, preferably with radial ribs, is provided, the upper periphery of the base having spaced upstanding towers with openings depending from the upper ends thereof. Upstanding posts are also provided, each post having a lower end received within the upper end of a tower, each post having an upper end with a recess for receiving a downwardly depending projection.

3 Claims, 4 Drawing Sheets

CHILD EXERCISER/ROCKER

RELATED APPLICATION

This application is a Continuation-In-Part Application of U.S. patent application Ser. No. 08/130,206, filed Oct. 1, 1993, now U.S. Pat. No. 5,407,246.

BACKGROUND OF THE INVENTION

1. Field of the Invention

This invention relates to a child exerciser/rocker and, more particularly, to a device for exercising and entertaining a child having a seat for supporting a child with an associated tray and a bowl-shaped base to facilitate rocking, engagable feet to preclude rocking, spring couplings between the seat and the base to facilitate bouncing with height adjustment components between the base and seat and with bearing surfaces between the seat and tray to facilitate 360 degree rotation with locking components therebetween to preclude rotation when so desired.

2. Description of the Background Art

There are a wide variety of devices in the marketplace today in which children may be placed for exercise. Similarly, there are a wide variety of devices in the marketplace today in which children may be placed for entertainment. In a limited number of cases, devices for entertainment may provide exercise and, conversely, devices for exercise may provide entertainment. In all such instances, however, care must be taken in the design and use of such devices to insure the maximum safety of the child as well as the peace of mind of the mother.

Typical devices attempting to meet such needs are disclosed in the patent literature. Consider, for example, U.S. Pat. No. 4,025,107 to Chippa; U.S. Pat. No. 4,084,273 to Haynes; U.S. Pat. No. 4,141,588 to Anderson; U.S. Pat. No. Des. 295,397 to Brownlie et al; U.S. Design Pat. 315,644 to White; and U.S. Pat. No. 5,178,438 to Beger.

Despite the large number of efforts to meet the needs of child and mother for exercise and entertainment of young ones, along with maximum safety, no prior art device has the capability of the present invention which provides for a combination of bouncing, rotating, and rocking, all for a maximum safety of the child in mind.

Accordingly, it is an object of the present invention to provide a seat for receipt of a child capable of providing exercise and entertainment comprising a seat having a rigid upper support and a lower support therebeneath and a circular bearing surface therebetween, the lower support having leg openings for passage of the legs of a child supported therein. An upper supporting tray has a radially interior opening in a circular configuration for receiving and supporting the seat, the upper supporting tray having a radially exterior periphery with projections extending downwardly therefrom. A bowl-shaped base, preferably with radial ribs, is provided. The upper periphery of the base has spaced upstanding towers with openings at the upper ends thereof. Upstanding posts are also provided, each post having a lower end received within the upper end of a tower, each post having an upper end with a recess for receiving a downwardly depending projection.

A further object of the present invention is to exercise a child while the child is entertaining itself.

A further object of the present invention is to entertain a child while it is exercising itself.

It is a further object of the present invention to insure a child's safety while the child is exercising and entertaining through a combination of bouncing, rocking and rotating.

These objects should be construed to be merely illustrative of some of the more prominent features and applications of the intended invention. Many other beneficial results can be obtained by applying the disclosed invention in a different manner or by modifying the invention within the scope of the disclosure. Accordingly, other objects and a more comprehensive understanding of the invention may be obtained by referring to the summary of the invention, and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purposes of summarizing the invention, the invention may be incorporated into a seat for receipt of a child capable of providing exercise and entertainment for a child supported therein comprising, in combination, a seat having a rigid upper support and a lower support therebeneath and a circular bearing surface therebetween, the lower support having leg openings for passage of the legs of a child supported therein. An upper supporting tray in a circular configuration has a radially interior opening for receiving and rotatably supporting the seat at the circular bearing surface, the upper supporting tray having a radially exterior periphery in a circular configuration with three equally spaced projections extending downwardly therefrom. A bowl-shaped base, preferably with radial ribs, and adapted to rock in any direction is also provided, the upper periphery of the base having three equally spaced upstanding towers in parallel relationship with vertical openings at the upper ends of the towers, each tower having vertically spaced height adjustment holes formed therein. Three vertically extending posts are provided, each post having a lower end received within the upper end of a tower with a spring based operator controlled button positionable through a hole in the tower for varying the height of the post with respect to the tower, each post having an upper end with a recess for receiving a downwardly depending projection to preclude rotation therebetween, and a spring between each post and tower to allow bouncing of a child in the seat with respect to the base. A lock couples the seat and the tray movable between a locking orientation to preclude rotation therebetween and an unlocking orientation to allow rotation therebetween. Three feet depend from the lower surface of the base from equally spaced peripheral locations and movable between a recessed orientation to allow rocking and an extended orientation to preclude rocking.

The foregoing has outlined rather broadly, the more pertinent and important features of the present invention. The detailed description of the invention that follows is offered so that the present contribution to the art may be more fully appreciated. Additional features of the invention will be described hereinafter. These form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a more succinct understanding of the nature and objects of the invention, reference should be directed to the following description taken in conjunction with the accompanying drawings in which.

Similar reference numerals refer to similar parts throughout the several Figures.

DETAILED DESCRIPTION OF THE PREFERRED EMBODIMENT OF THE INVENTION

Figure 1:
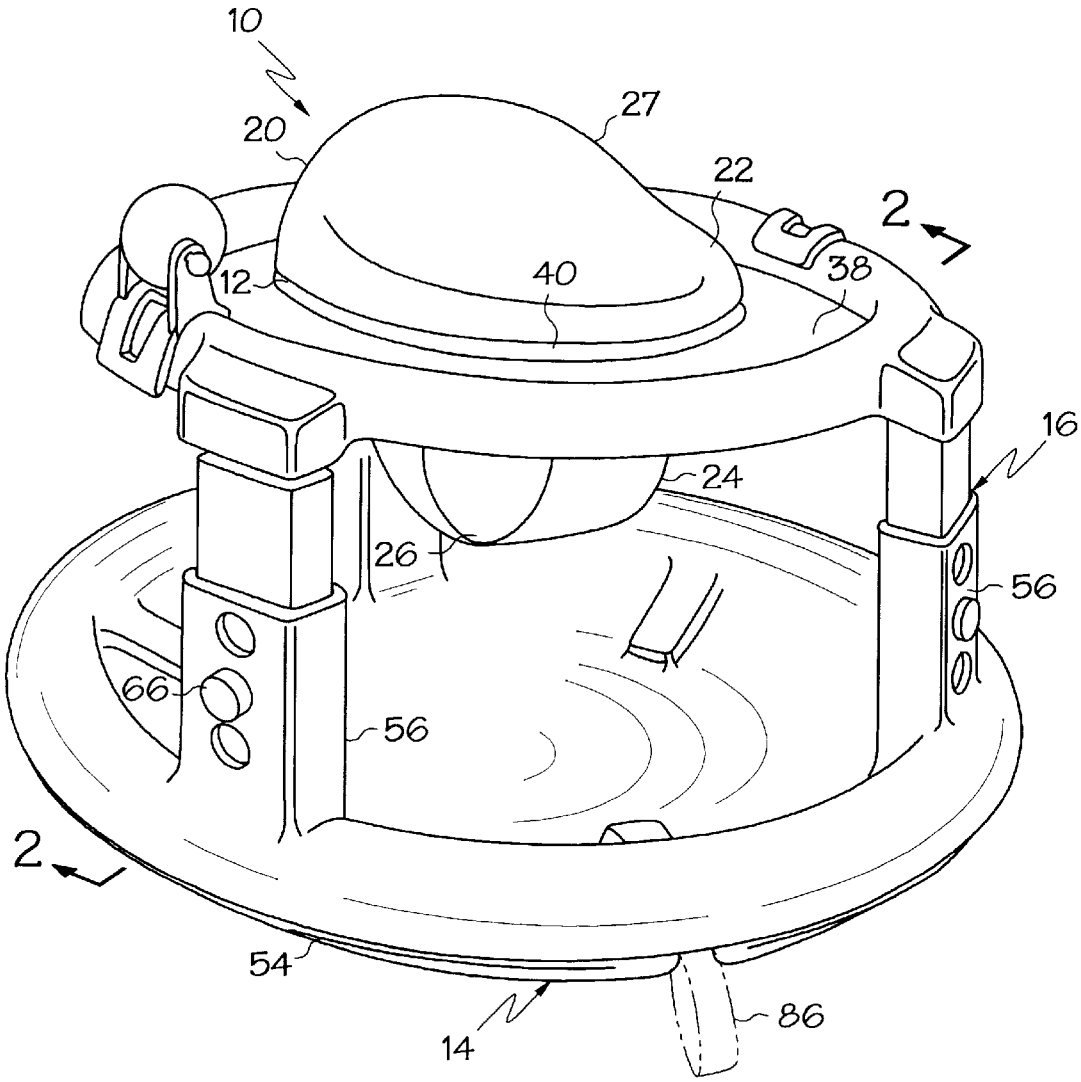
FIG. 1 is a perspective illustration of the child exerciser/rocker constructed in accordance with the principals of the present invention.

Shown in the Figures, with particular reference to FIG. 1, there is shown a child exerciser/rocker 10 constructed in accordance with the principles of the present invention. From an overview standpoint, the child exerciser/rocker includes three major assemblies, a seat assembly 12, a base assembly 14, and a coupling assembly 16 therebetween.

With regard to the seat assembly 12, a seat 20 is provided for receipt of a child who is to receive the exercise and the entertainment while supported therein. The seat 20 comprises a rigid upper support 22 and a soft flexible lower support 24 therebeneath. Leg openings 26 are formed in the forward portion of the lower support for passage of the legs of a child supported therein.

The rigid upper support 22 is covered with a soft cushion 27. The cushion 27 is removably secured in position by elastic loops 29 permanently secured at their upper ends to the cushion and removably secured at their lower ends to a bearing retainer 31. Note FIG. 10.

Between the upper and lower supports 22 and 24 of the seat are spherical ball bearing members 30. Such ball bearing members are adapted to cooperate with an associated downwardly facing bearing surface 32 coupled to the seat. The bearing surface is also adapted to cooperate with an associated upwardly facing bearing surface 34. The bearing surface 32 is coupled to the tray components. This arrangement allows for circular rotation of the seat through 360 degrees with respect to the tray and base components therebeneath.

Extending radially outwardly from the circular bearing surface is a lower supporting structure in the form of a tray 38. Such tray has a radially interior opening 40 in a circular configuration sized and shaped for receiving and rotatably supporting the seat 20. Such support is at a location between the upper and lower supporting structures 22 and 24 of the seat. The lower supporting structure or tray also has a radially exterior periphery 42 formed as an upwardly extending flange in a circular configuration. Depending downwardly from adjacent to the exterior periphery of the tray are three conical projections 44. The conical projections assist in the locating and coupling of the seat tray, and upper supporting structures with respect to the components therebeneath. Associated lag bolts 45 and threaded apertures 47 in the tray loosely couple the tray 38 with the posts 62 and as such also function to couple the tray with respect to the posts 62 and base. Other types of bolts including screws could readily be used as a substitute for lag bolts 45.

A bowl-shaped base 54 at the bottom of the device is also provided. Such base is spherical in configuration at its lower extent and is adapted to rock in any direction. It is also adapted to rock the components supported thereabove. The upper periphery of the base is formed with three vertically extending and equally spaced upstanding towers 56. The towers extend in parallel relationship with respect to each other. Their upper ends are formed with openings 58 extending downwardly from their upper ends.

Three vertically extending posts 62 are also provided. Each post has a lower end received within a recess 58 of a upper end of a tower 56. An operator-controlled button 66 extends through each post and tower and is urged outwardly by a spring 68. This arrangement functions to fix the height of the post and seat with respect to the towers 56 and base 54. The buttons 66 may be depressed by a user to raise or lower the posts 62. In this manner a user may vary the height of the post and seat 20 with respect to the towers 56 and base 54.

Each post also has an upper end with a recess 72 for receiving a downwardly depending cone shaped projection 44 extending downwardly from the exterior periphery of the support structure. Such projections and recesses function in association with lag bolts 45 to locate the seat and tray with respect to the towers and base and to preclude rotation between the tray and base.

A spring 76 is operatively positioned between each post 62 and projection 44 of the support structure. Such springs 76 allow for bouncing of a child in the seat 20 with respect to the towers 56 and base 54. As such, a child in the seat 20 may rotate and/or bounce and/or rock by the shifting of his or her weight and the movement of his or her feet on the upper surface of the base 54.

The lower retainer has outwardly facing teeth 80 which may be engaged by a slide 82 on the bottom of the tray 28. The slide is movable by the user between an operative position out of contact with the teeth 80 to allow rotation of the seat and an inoperative position to engage the teeth to preclude rotation of the seat when so desired.

Lastly, three feet 86 are provided on the lower surface of the base. Each foot is pivotally secured by a hinge pin 88 in recesses 90 in the base. The feet are urged by springs 92 to the position in which they are set and to retain such set position. The feet are movable about their hinge pins 88 by a user between a recessed orientation within the recesses 90 to allow rocking and an extended orientation exterior of the recesses 90 to preclude rocking.

Figure 6:
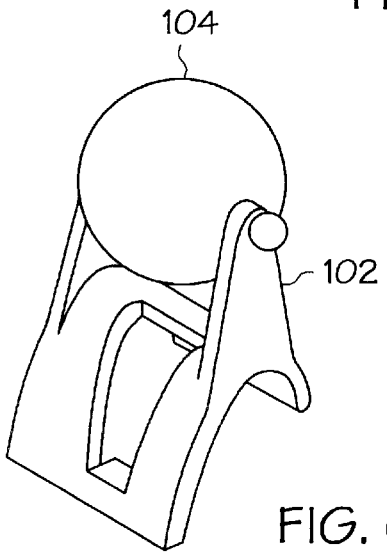
FIGS. 6 and 7 are perspective illustrations of toys adapted to be coupled to the tray.
Figure 7:
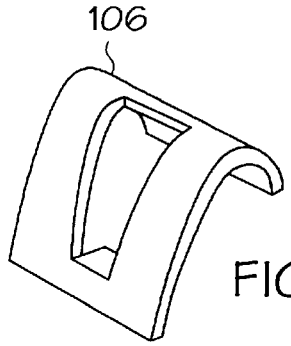
Figure 2:
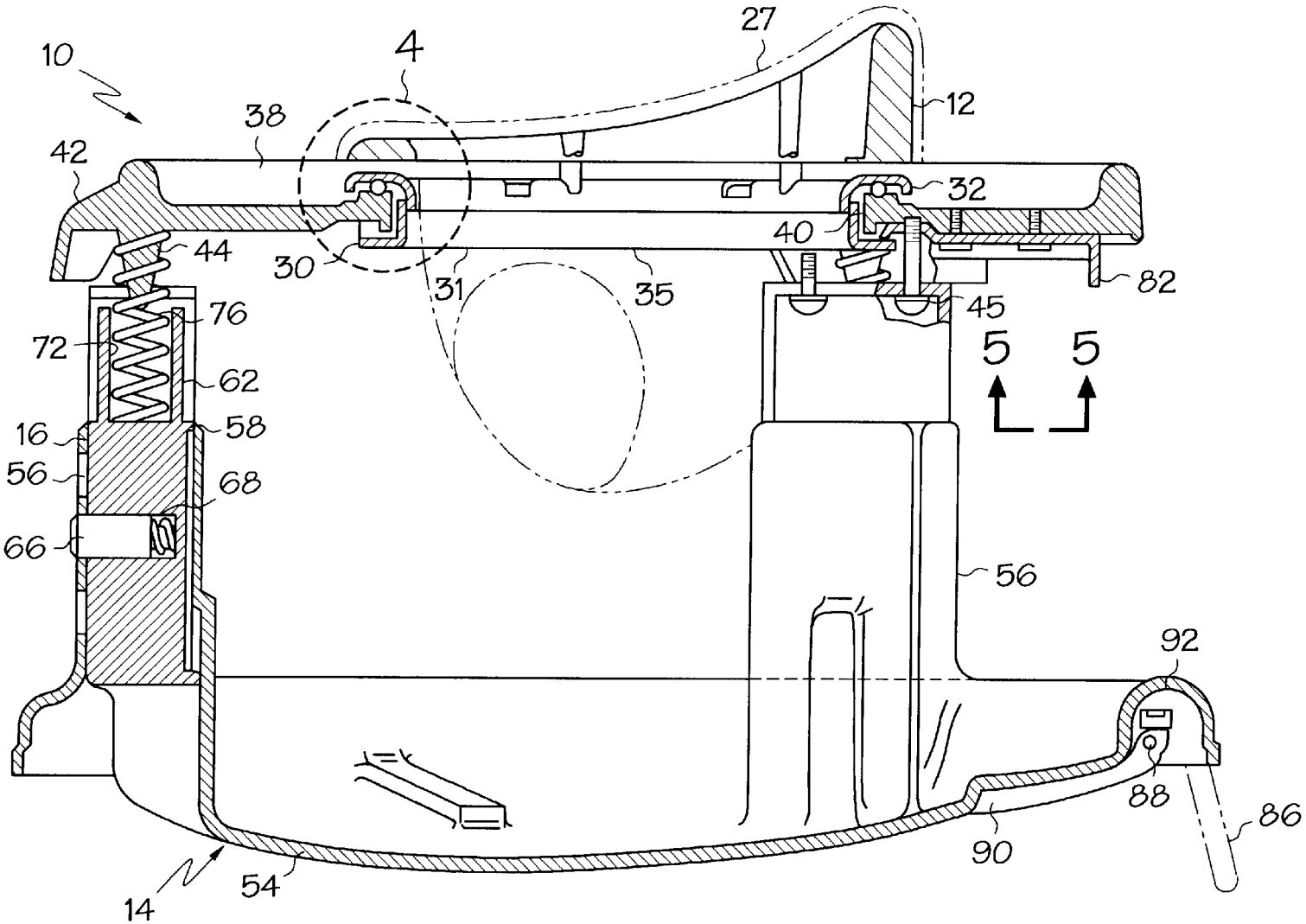
FIG. 2 is a sectional view of the child exerciser/rocker taken along line 2—2 of FIG. 1.
Figure 3:
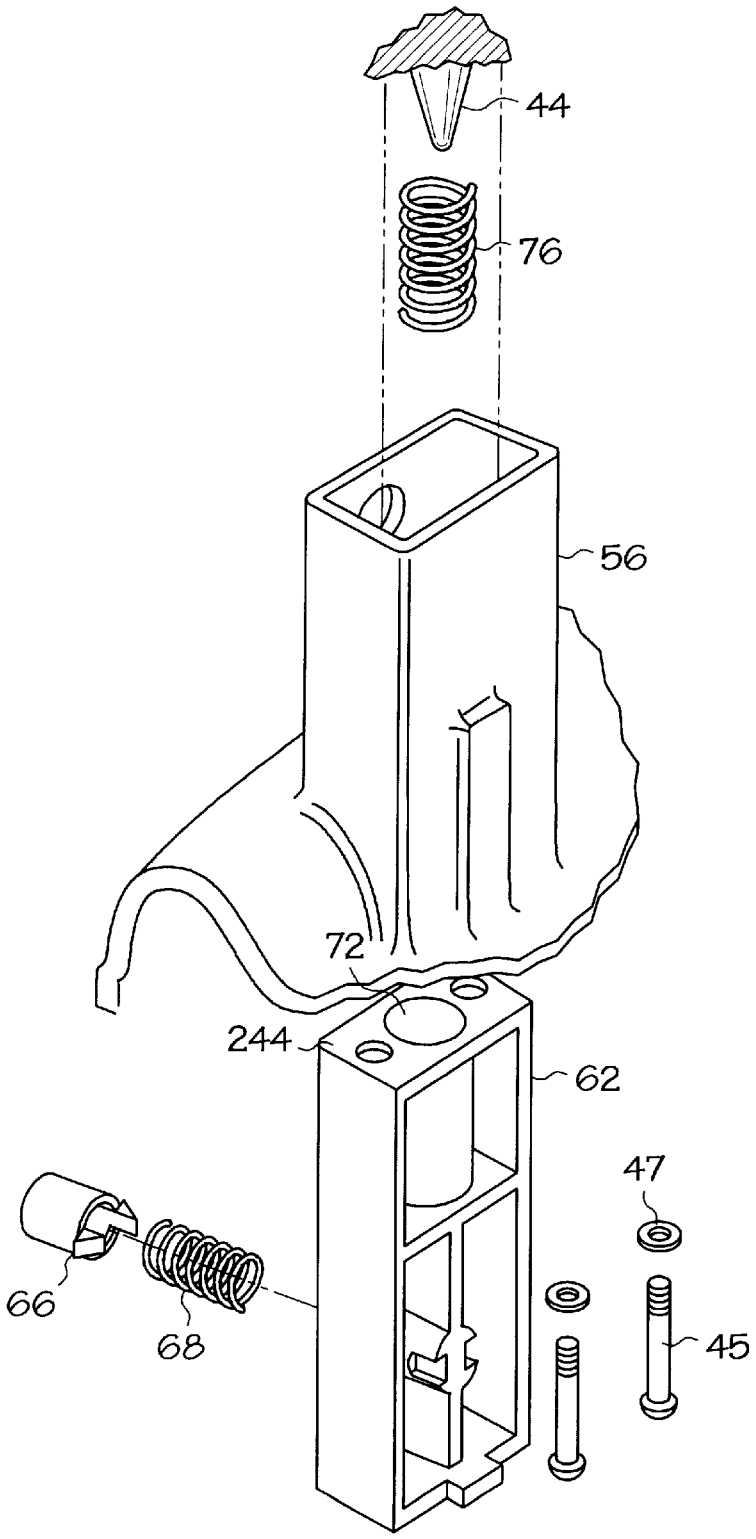
FIG. 3 is an exploded perspective view of the coupling mechanisms between the tray and base.
Figure 4:
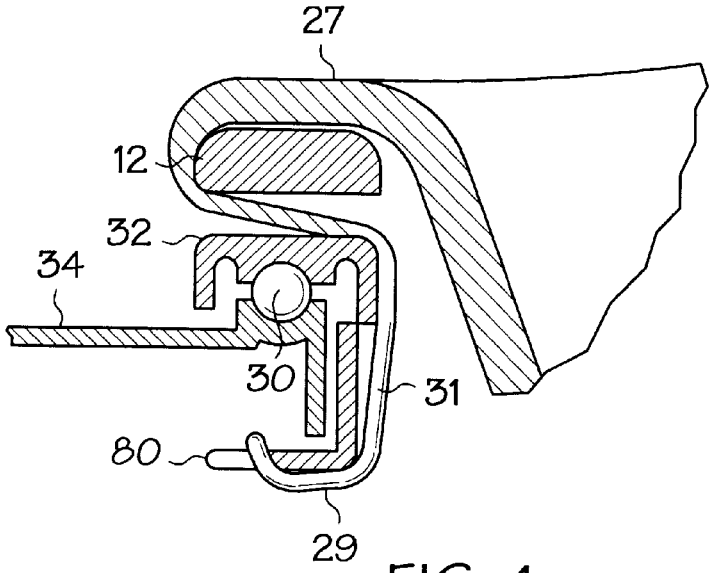
FIG. 4 is an enlarged sectional view of the area of coupling between the seat and the tray.
Figure 5:
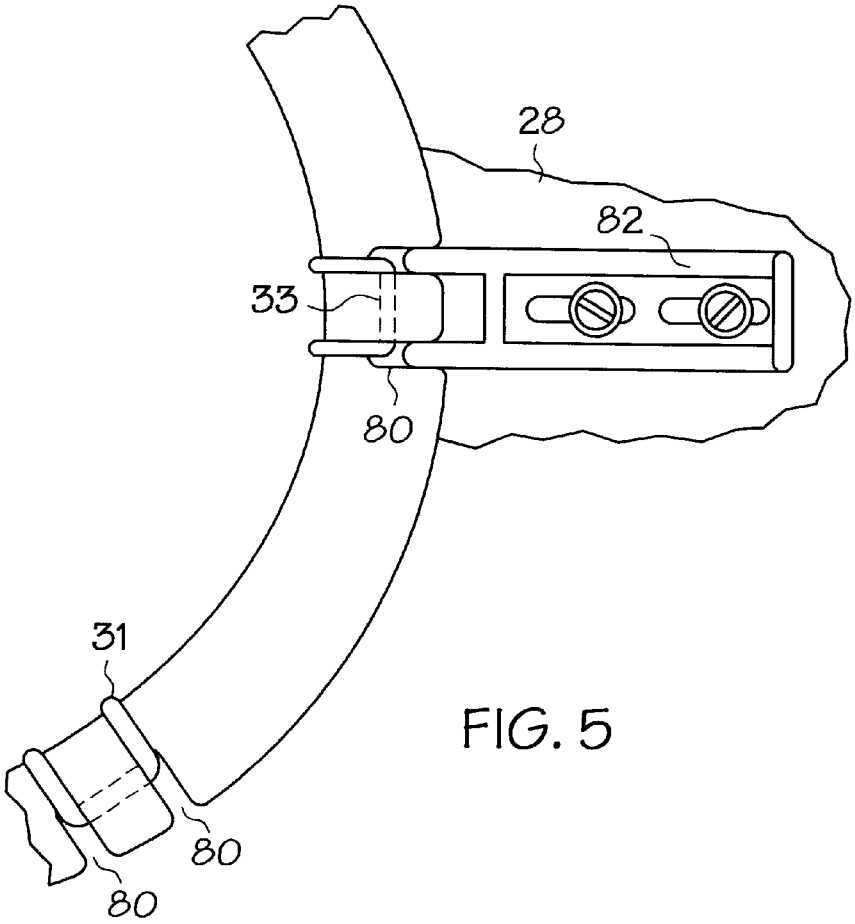
FIG. 5 is an enlarged showing of the locking mechanisms between the seat and the tray.

Optionally provided with the above described device are one or more toys removably coupled with respect to the flange of the tray. By way of example, toy 102 has a clip positionable over the flange with upstanding side walls supporting a ball 104 located on a pivot pin. Note FIG. 6. FIG. 7 is a clip 106 adapted to support a toy of any other type. Any of a wide variety of clips, toys and interconnections therebetween could readily be utilized. Although this invention has been described in its preferred form with a certain degree of particularity, it should be understood that the present disclosure of the preferred form has been made only by way of example and that numerous changes in the details of construction and combination and arrangement of parts may be resorted to without departing from the spirit and scope of the invention.

Now that the invention has been described,

What is claimed is:

1. A seat for receipt of a child capable of providing exercise and entertainment for a child supported therein comprising, in combination:

a seat having a rigid upper support and a lower support therebeneath and a circular bearing surface therebetween, the lower support having leg openings for passage of the legs of a child supported therein;

an upper supporting tray in a circular configuration having a radially interior opening for receiving and rotatably supporting the seat at the circular bearing surface, the upper supporting tray having a radially exterior periphery in a circular configuration with a plurality of equally spaced projections extending downwardly therefrom;

a bowl-shaped base adapted to rock in any direction, the upper periphery of the base having three equally spaced upstanding towers in parallel relationship with vertical openings at the upper ends of the towers, each tower having vertically spaced height adjustment holes formed therein;

three vertically extending posts, each post having a lower end received within the upper end of one of said towers with a spring based operator controlled button positionable through a hole in the tower for varying the height of the post with respect to the tower, each post having an upper end with a recess for receiving one of said downwardly depending projections to preclude rotation therebetween, and a spring between each post and its associated projection to allow bouncing of a child in the seat with respect to the base;

a lock coupling the seat and the tray movable between a locking orientation to preclude rotation therebetween and an unlocking orientation to allow rotation therebetween; and three feet depending from the lower surface of the base from equally spaced peripheral locations and movable between a recessed orientation to allow rocking and an extended orientation to preclude rocking.

2. A seat for receipt of a child capable of providing exercise and entertainment for a child supported therein comprising, in combination:

a seat having a rigid upper support and a lower support therebeneath, the lower support having leg openings for passage of the legs of a child supported therein;

an upper supporting tray having a radially interior opening for receiving and supporting the seat, the upper supporting tray having a radially exterior periphery in a closed configuration with a plurality of equally spaced projections extending downwardly therefrom;

a bowl-shaped base adapted to rock in any direction, the upper periphery of the base having equally spaced upstanding towers in parallel relationship with vertical openings at the upper ends of the towers, each tower having vertically spaced height adjustment holes formed therein;

a plurality of vertically extending posts, each post having a lower end received within the upper end of one of said towers with a spring based operator controlled button positionable through a hole in the tower for varying the height of the post with respect to the tower, each post having an upper end with a recess for receiving one of said downwardly depending projections to preclude rotation therebetween, and a spring between each post and its associated projection to allow bouncing of a child in the seat with respect to the base; and a plurality of feet depending from the lower surface of the base from equally spaced peripheral locations and movable between a recessed orientation to allow rocking and an extended orientation to preclude rocking.

3. A seat for receipt of a child capable of providing exercise and entertainment for a child supported therein comprising, in combination:

a seat having a rigid upper support and a lower support therebeneath and a circular bearing surface therebetween, the lower support having leg openings for passage of the legs of a child supported therein;

an upper supporting tray having a radially interior opening for receiving and rotatably supporting the seat at the circular bearing surface, the upper supporting tray having a radially exterior periphery in a circular configuration with a plurality of equally spaced projections extending downwardly therefrom;

a base, the upper periphery of the base having a plurality of equally spaced upstanding towers in parallel relationship with vertical openings at the upper ends of the towers, each tower having vertically spaced height adjustment holes formed therein;

a plurality of vertically extending posts, each post having a lower end received within the upper end of one of said towers with a spring based operator controlled button positionable through a hole in the tower for varying the height of the post with respect to the tower, each post having an upper end with a recess for receiving one of said downwardly depending projections to preclude rotation therebetween, and a spring between each post and its associated projection to allow bouncing of a child in the seat with respect to the base; and a lock coupling the seat and the tray movable between a locking orientation to preclude rotation therebetween and an unlocking orientation to allow rotation therebetween.

* * * * *